US006959700B2

(12) United States Patent
Wu et al.

(10) Patent No.: US 6,959,700 B2
(45) Date of Patent: Nov. 1, 2005

(54) FLOW DEFLECTOR FOR A PIPE

(75) Inventors: Shouhao Wu, Roselle, IL (US); Yuanxian Zhu, Naperville, IL (US); Wesley J. Terry, Union, IL (US); Laura Ricart-Ugaz, Chicago, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/803,322

(22) Filed: Mar. 18, 2004

(65) Prior Publication Data

US 2005/0205070 A1 Sep. 22, 2005

(51) Int. Cl.[7] ..... F02M 25/07

(52) U.S. Cl. ..... 123/568.17; 123/568.12; 60/605.2

(58) Field of Search ..... 123/568.11, 568.12, 123/568.15, 568.17, 568.18, 568.19; 60/605.2

(56) References Cited

U.S. PATENT DOCUMENTS 1,476,942 A * 12/1923 Youngblood ..... 123/568.17
1,541,583 A * 6/1925 Merz ..... 123/568.17
2,084,142 A * 6/1937 Horton ..... 123/568.11
3,530,843 A * 9/1970 De Witt ..... 123/568.11
3,866,586 A * 2/1975 Scott, Jr. ..... 123/568.17
4,194,475 A 3/1980 Saiki
4,222,356 A 9/1980 Ueda et al.
4,294,220 A * 10/1981 Yasuhara et al. ..... 123/568.11
4,364,369 A 12/1982 Nomura et al.
4,823,759 A 4/1989 Mitani
4,895,125 A * 1/1990 Geiger ..... 123/568.11
5,492,104 A 2/1996 Elder et al.
5,533,487 A * 7/1996 Cailey ..... 123/568.17
5,785,034 A 7/1998 Moedinger et al.
5,975,064 A 11/1999 Krimmer et al.
6,293,265 B1 9/2001 Gagnon
6,425,382 B1 7/2002 Marthaler et al.
6,427,671 B1 8/2002 Holze et al.
6,604,516 B1 8/2003 Krimmer et al.

* cited by examiner

*Primary Examiner*—Willis R. Wolfe, Jr.
(74) *Attorney, Agent, or Firm*—Susan L. Lukasik; Dennis Kelly Sullivan; Jeffrey P. Calfa

(57) ABSTRACT

An apparatus includes an inlet (121) at a first end of a pipe (115), wherein a flow of fluid enters the inlet (121). A first outlet (123) is at a second end of the pipe (115). A second outlet (125) is disposed between the first end and the second end of the pipe (115). A flow deflector (201) deflects a first part of the flow out of the second outlet (125). A second part of the flow exits the first outlet (123).

20 Claims, 2 Drawing Sheets

FLOW DEFLECTOR FOR A PIPE

FIELD OF THE INVENTION

This invention relates to internal combustion engines, including but not limited to recirculation of exhaust in internal combustion engines.

BACKGROUND OF THE INVENTION

Internal combustion engines typically include an air intake system, a combustion chamber, and an exhaust system. The air intake system drives air into the engine combustion chamber. The air intake system is pressurized, for example, by a turbocharger, to drive the air into the combustion chamber during an intake cycle. Air and fuel are combined in the combustion chamber. Exhaust gas is emitted from the combustion chamber during an exhaust cycle.

Internal combustion engines are known to include exhaust gas recirculation (EGR) systems to reduce nitrous oxide (NOx) emissions. A fraction of the exhaust gas is diverted from entering the turbine and routed back through an EGR system into the intake manifold. The resultant air charge to the cylinder contains both fresh air and combusted exhaust gas. It is desirable to improve EGR flow rate to reduce engine emissions while maintaining reasonable fuel economy performance. If a sufficient volume of exhaust gas is not recirculated, the desired impact may not be achieved.

Accordingly, there is a need for an EGR system that provides a volume of recirculated exhaust gas to achieve the desired EGR impact.

SUMMARY OF THE INVENTION

An apparatus includes an inlet at a first end of a pipe, wherein a flow of fluid enters the inlet. A first outlet is at a second end of the pipe. A second outlet is disposed between the first end and the second end of the pipe. A flow deflector deflects a first part of the flow out of the second outlet.

DESCRIPTION OF A PREFERRED EMBODIMENT

The following describes an apparatus for and method of making a flow deflector that deflects an inlet flow into one of two or more outlets of a pipe. The flow deflector is disposed within the pipe. The flow deflector may advantageously be utilized to direct exhaust gas into an EGR system or to direct EGR output into an air intake stream. The flow deflector may be formed from the pipe itself, or attached to an opening formed in the pipe.

Figure 1:
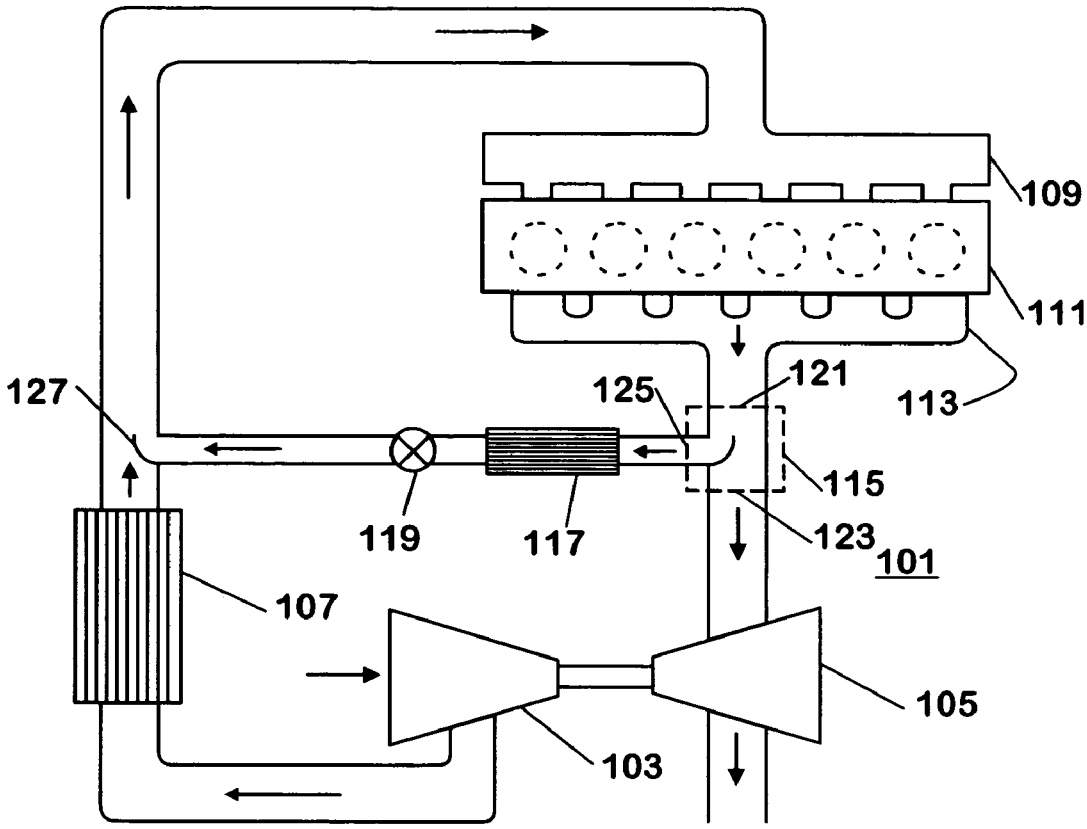
FIG. 1 is a block diagram of an internal combustion engine in accordance with the invention.

A block diagram of an internal combustion engine 101 utilizing an EGR system is shown in FIG. 1. Air enters a compressor 103 of a turbocharger that includes a turbine 105. Compressed air exits the compressor 103 and is cooled by an intercooler 107. Cooled air output by the intercooler

107 enters the intake manifold 109, before entering the cylinders 111. Exhaust gas from the cylinders 111 enters an exhaust manifold 113 and passes into a tube 115 that feeds part of the exhaust gas into an EGR system, such as an EGR cooler 117 and EGR valve 119, and the rest of the exhaust gas into the turbine 105, where it exits the system. Cooled exhaust gas and compressed air are combined in the intake manifold 109, and the resultant stream is provided to the cylinders 111.

Figure 2:
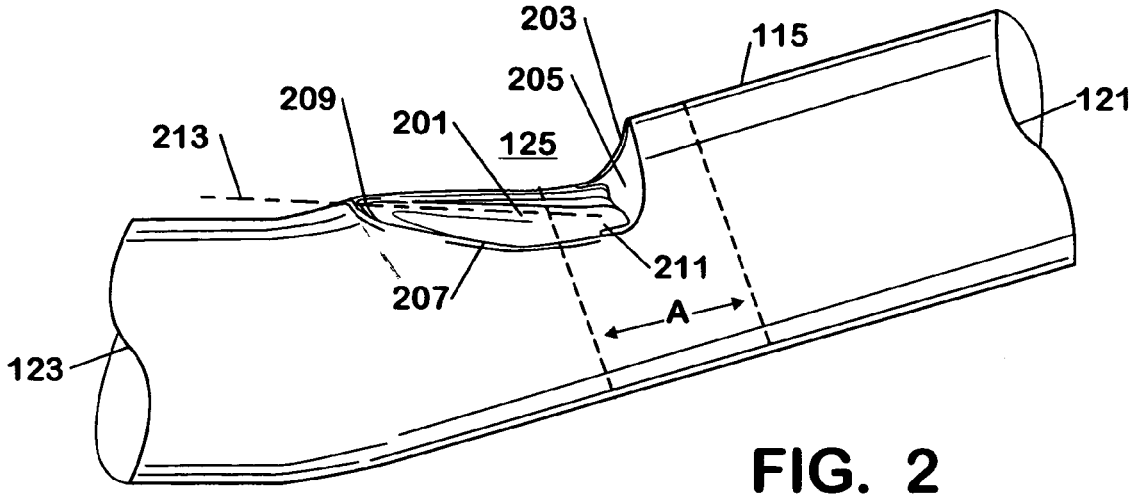
FIG. 2 is a perspective view of a pipe having a flow detector in accordance with the invention.
Figure 4:
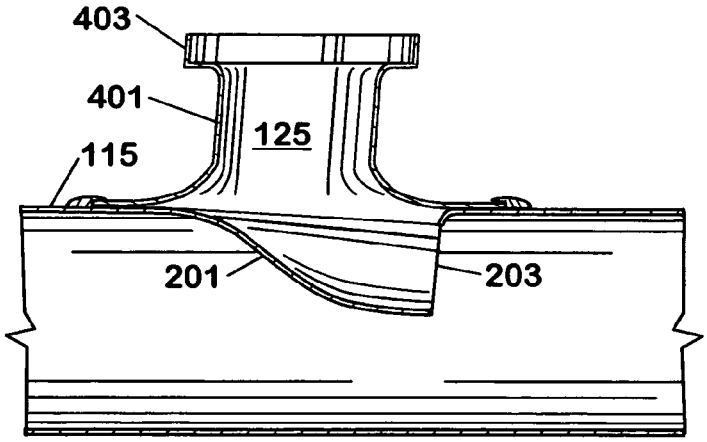
FIG. 4 is a vertical cross-section of a section of the pipe and the flow detector in accordance with the invention.

A perspective view of a pipe having a flow detector 201 is shown in FIG. 2. The flow deflector 201 is disposed inside the exhaust pipe 115. The flow deflector 201 may be formed in a variety of ways. In one embodiment, a slot 203 is formed partially through the outer circumference of the pipe 115. The slot 203 may take on various shapes, including, for example, curved as shown in FIG. 2 or angled as shown in FIG. 4. A section of the pipe 115 near the slot 203 and closer to the outlet 123 that to the inlet 121 is depressed into the pipe 115, for example, by a machine die, thereby forming a flow deflector 201 and an opening 205 between the flow deflector 201 and the edge of the slot 203. In this embodiment, the lack of welded or brazed joint at the interface 207 between the pipe and the flow deflector 201 makes it easier to eliminate leak paths. This embodiment is also less expensive to manufacture than attaching a separator flow deflector 201 because the "piercing" process does not require fabrication.

In another embodiment, the flow deflector 201 may be formed as a separate pieced and welded, brazed, or otherwise connected to a part of the edge 207 of a large opening that is formed in the pipe 115. The flow deflector 201 advantageously is connected along a substantial part of the edge 207 of the large opening, e.g., from one end of the opening 205 around the edge 207 to the other end of the opening 207, to provide better deflection of flow from in the inlet to the outlet 125 of the pipe. The flow deflector 201 may be manufactured from a heat resistant material. This embodiment is easily utilized to retrofit existing exhaust (or intake) pipes 115.

The flow deflector 201 advantageously has a shallow end 209 near the outlet 123 and a wide end 211 near the inlet 123. The wide end 211 may have a tongue that extends into the pipe 115. The wide end 211 advantageously extends a distance radially further into the pipe 115 than the shallow end 209 extends radially into the pipe 115. The flow deflector 201 may taken on various shapes, including a rounded, scooped, trough, ramped, and so forth. The flow deflector 201 may be curved or ramped both axially and radially. The flow deflector 201 advantageously curves or ramps gradually between the wide end 211 and the shallow end 209. The flow deflector 201 advantageously has a concave surface that faces the outlet 125.

In one embodiment, the flow deflector 201 may be seen as formed of three walls, two side walls and a bottom (bottom from the perspective of the drawing, although not necessarily the orientation with respect to the ground) wall between the two side walls. The tops of the side walls form part of the edge 207. The walls merge at the shallow end 209, and the ends of the side walls and the bottom wall form the opening 205 at the wide end 211 of the flow deflector 201. The walls are shaped to form the desired flow into the outlet 125 of the pipe 115, which outlet 125 may be input to an EGR system. The walls may be separately formed or formed from a single piece of material, including being formed from the pipe 115 itself.

As hot pressurized exhaust gas exits the exhaust manifold 113, the pressure in the exhaust manifold 113 increases. The pressure in the exhaust manifold 113 dynamically changes by increasing after each exhaust cycle and dropping as the exhaust gas dissipates in the exhaust pipe 115, which effect is also referred to as "pulse energy." This dynamic change in pressure in the exhaust manifold 113 creates a dynamic pressure wave in the exhaust pipe 115. The pressure wave is a driving force that propels exhaust from the exhaust manifold 113 into the exhaust inlet 121 of the exhaust pipe 115. The flow deflector 201 captures and redirects a part of the exhaust gas out the outlet 125, while the remaining part of the exhaust gas exits the other outlet 123. The flow deflector 201 deflects the pressure wave to propel the exhaust gas to the EGR system or other system. The flow deflector 201 advantageously deflects flow out the outlet 125 with more efficiency than a simple T or Y junction. The use of the flow deflector 201 helps to eliminate the need for an additional device, such as a pump, to drive gas into the EGR system or other system.

Figure 3:
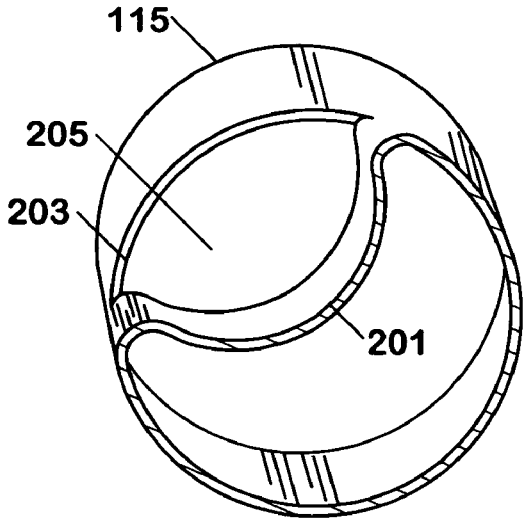
FIG. 3 is a cross-sectional view of an axial section of the pipe and the flow detector in accordance with the invention.

A cross-sectional view of an axial section of the pipe and the flow detector is shown in FIG. 3. The axial section of the pipe is shown as section A in FIG. 2. The flow deflector 201 advantageously has a concave surface that faces the outlet 125. The flow deflector 201 extends across the opening 205 in the pipe 115.

A vertical cross-section of a section of the pipe and the flow detector is shown in FIG. 4. The cross-section of FIG. 4 is shown through a vertical plane drawn through the flow deflector 201 when the flow deflector 201 is placed vertically at the top side of the exhaust pipe 115. The exhaust pipe 115, however, need not be oriented in this manner when installed in an engine 101.

The outlet 125 is attached to the EGR system inlet via a conduit 401 and optional flange 403. The conduit 401 may optionally attach directly to the EGR cooler 117, EGR valve 119, regenerator (not shown), or other EGR system apparatus. The conduit 401 is welded, brazed, or otherwise connected to the pipe 115 such that the flow deflected by the flow deflector 201 is deflected down the conduit 401 and into the EGR system or other system. The wide end 211 of the flow deflector 201 extends radially into the pipe 115 as far as needed to provide the desired amount of exhaust gas into the EGR system. The flow deflector 201 is aligned axially and radially with the outlet 125 to achieve desired flow from the inlet 121 to be redirected out the outlet 125.

Although the flow deflector 201 is described above in through the example of an exhaust pipe, the flow deflector 201 may also be implemented in the intake system, for example as shown by reference numeral 127 in the intake pipe in FIG. 1. The intake pipe in this example has two inlets, one from the intercooler 107 and one from the EGR system, and one outlet that connects to the intake manifold 109. The flow deflector 201 may also be utilized in other applications that are not EGR related.

The present invention provides a number of advantages. The flow deflector may be formed from the exhaust pipe or manufactured separately and mounted to the pipe. The flow deflector may be retrofitted into existing exhaust pipes, intake pipes, or other types of pipes. Additional equipment is not required to increase exhaust gas volume into the EGR system. Inexpensive manufacture and no maintenance after installation are also advantages. The deflector may provide advantage over a moveable valve that has position tolerance issues.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. An apparatus comprising:

a inlet at a first end of a pipe, wherein a flow of fluid enters the inlet;

a first outlet at a second end of the pipe;

a second outlet disposed between the first end and the second end of the pipe;

a flow deflector arranged and constructed to deflect a first part of the flow out of the second outlet, wherein the flow deflector has a shallow end disposed closer to the second end of the pipe than to the first end of the pipe, and wherein the flow deflector has a wide end disposed closer to the first end of the pipe than to the second end of the pipe.

2. The apparatus of claim 1, wherein the flow deflector is formed from a section of the pipe, which section is depressed into the pipe next to a slot formed in the pipe, such that the second outlet is comprised of the depressed section of the pipe and an opening formed between the slot and the depressed section of the pipe.

3. The apparatus of claim 1, wherein the flow deflector is attached to a part of an edge of a hole formed in the second outlet.

4. The apparatus of claim 1, further comprising a conduit dispose near the second outlet such that the first part of the flow is deflected by the flow deflector into the conduit.

5. The apparatus of claim 1, wherein the flow deflector is formed as a separate piece that is connected to the pipe.

6. The apparatus of claim 1, wherein the flow deflector curves gradually between the shallow end and the wide end.

7. The apparatus of claim 1, wherein the wide end extends radially further into the pipe than the shallow end extends radially into the pipe.

8. The apparatus of claim 1, wherein the flow deflector has a shape that is at least partially curved.

9. The apparatus of claim 1, wherein the flow deflector has a concave surface that faces the second outlet.

10. The apparatus of claim1, wherein the flow deflector directs exhaust gas into an exhaust gas recirculation system of an internal combustion engine.

11. The apparatus of claim1, wherein the flow deflector directs gas from an exhaust gas recirculation system into an air intake manifold of an internal combustion engine.

12. The apparatus of claim1, wherein the flow deflector comprises a tongue that extends into the pipe in a direction at least partially toward the inlet.

13. An apparatus comprising:

a inlet at a first end of a pipe;

a first outlet at a second end of the pipe;

a second outlet disposed between the first end and the second end of the pipe;

a flow deflector arranged and constructed such that when a flow of fluid enters the inlet, a first part of the flow is deflected by the flow deflector out the second outlet;

wherein the flow deflector is formed from a section of the pipe, which section is depressed into the pipe near a slot formed partially through the pipe.

14. The apparatus of claim 13, further comprising a conduit dispose near the second outlet such that the first part of the flow is deflected by the flow deflector into the conduit.

15. The apparatus of claim 13, wherein the flow deflector has a shallow end disposed closer to the second end of the pipe than to the first end of the pipe, wherein the flow deflector has a wide end disposed closer to the first end of the pipe than to the second end of the pipe, and wherein the wide end extends radially further into the pipe than the shallow end extends radially into the pipe.

16. The apparatus of claim 13, wherein the flow deflector has a shape that is at least partially curved.

17. The apparatus of claim 13, wherein the flow deflector has a concave surface that faces the second outlet.

18. The apparatus of claim 13, wherein the flow deflector directs exhaust gas into an exhaust gas recirculation system of an internal combustion engine.

19. An apparatus comprising:

a inlet at a first end of a pipe;

a first outlet at a second end of the pipe;

a second outlet disposed between the first end and the second end of the pipe;

a flow deflector arranged and constructed such that when a fluid enters the inlet, a first part of the flow is deflected by the flow deflector out the second outlet, wherein the flow deflector comprises:

a concave surface that faces the second outlet;

a shallow end disposed closer to the second end of the pipe than to the first end of the pipe;

a wide end disposed closer to the first end of the pipe than to the second end of the pipe, wherein the wide end extends radially further into the pipe than the shallow end extends radially into the pipe.

20. The apparatus of claim 19, wherein the flow deflector is formed from a section of the pipe, which section is depressed into the pipe next to a slot formed in the pipe, such that the second outlet is comprised of the depressed section of the pipe and an opening formed between the slot and the depressed section of the pipe.

* * * * *